US007835658B2

(12) United States Patent
Tsuzuki

(10) Patent No.: US 7,835,658 B2
(45) Date of Patent: Nov. 16, 2010

(54) IMAGE FORMING APPARATUS WHICH DETERMINES BILLING AMOUNT

(75) Inventor: Seiji Tsuzuki, Saitama-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 430 days.

(21) Appl. No.: 11/936,208

(22) Filed: Nov. 7, 2007

(65) Prior Publication Data

US 2008/0107440 A1 May 8, 2008

Related U.S. Application Data

(60) Provisional application No. 60/864,694, filed on Nov. 7, 2006.

(30) Foreign Application Priority Data

Sep. 21, 2007 (JP) ..... 2007-245692

(51) Int. Cl.
*G03G 21/02* (2006.01)

(52) U.S. Cl. ..... 399/79

(58) Field of Classification Search ..... 399/24, 399/27, 31, 79, 43, 80; 705/400
See application file for complete search history.

(56) References Cited

U.S. PATENT DOCUMENTS 4,058,815 A * 11/1977 Warner et al. ..... 399/79
5,383,129 A * 1/1995 Farrell ..... 705/400
6,216,113 B1 * 4/2001 Aikens et al. ..... 705/34
6,516,157 B1 * 2/2003 Maruta et al. ..... 399/8
6,574,443 B1 * 6/2003 Butikofer et al. ..... 399/79
6,801,731 B2 * 10/2004 Parker ..... 399/79
7,020,408 B2 * 3/2006 Lester et al. ..... 399/79
7,085,503 B2 * 8/2006 Mokuya ..... 399/8
7,127,433 B2 * 10/2006 Baker ..... 705/400
7,502,137 B2 * 3/2009 Morales et al. ..... 358/1.18
2005/0058468 A1 * 3/2005 Reynolds ..... 399/79

FOREIGN PATENT DOCUMENTS

JP 2003-122209 4/2003
JP 2004-325490 11/2004

* cited by examiner

*Primary Examiner*—Robert Beatty
(74) *Attorney, Agent, or Firm*—Turocy & Watson, LLP

(57) ABSTRACT

There is provided an image forming apparatus in which when printing is performed based on an electrophotographic process, counting is performed by a counter for each print operation, and billing corresponding to the kind of the print operation is performed based on the count value of the counter, and which includes, as counters, a number-of-sheet counter to count the number of sheets for each print operation, an integrating counter to integrate the counter value of the number-of-sheet counter, and a billing counter to determine billing from the counter values of the number-of-sheet counter and the integrating counter, and a multiplication rate previously stored in a data table.

7 Claims, 3 Drawing Sheets

IMAGE FORMING APPARATUS WHICH DETERMINES BILLING AMOUNT

CROSS-REFERENCE TO RELATED APPLICATIONS

This application is based upon and claims the benefit of priority from the prior the provisional Patent Application No. 60/864,694, filed on Nov. 7, 2006 and Japanese Patent Applications No. 2007-245692, filed on Sep. 21, 2007, the entire contents of which are incorporated herein by reference.

BACKGROUND OF THE INVENTION

1. Field of the Invention

The present invention relates to an image forming apparatus in which billing is calculated according to execution of a print operation.

2. Description of the Related Art

In the related art, there is known an image forming apparatus in which a dedicated mechanical hard counter used for calculation of billing is provided, counting is performed for each of output sheets and the billing is performed.

The billing is performed based on a difference in, as objects of the billing, the number of sheets on which printing is performed, the size, the material (for example, normal paper or OHP sheet) and the like. For example, in the case where the unit cost of a sheet of an A4 size is set to 10 yen, when the number of sheets printed is 10, the total of 100 yen of "unit cost×the number of sheets" is billed.

Besides, as another billing method, there is an image forming apparatus in which the usable number of sheets is previously stored by storage means and is set, a print operation is permitted within the set number of sheets, and the print operation becomes unable to be performed at the time point when the number of sheets printed exceeds the set number of sheets (for example, JP-A-2003-122209).

In the image forming apparatus having the billing management function as stated above, a definite numerical value of, for example, a unit cost, a multiplying rate or an adding rate, which is to become a standard for billing is generally called a "billing rate".

On the other hand, in recent years, also in a copying machine as an image forming apparatus, a stand-alone machine tends to reduce, and a machine which is connected to a network and has multi-functions of a copier, a printer, a facsimile and the like is becoming mainstream. In accordance with this, the kinds of objects which are counted for billing are increased. Then, instead of a hard counter, a so-called soft counter using an SRAM mounted with a backup battery or a nonvolatile memory such as a writable EEPROM comes to be used as a billing counter (for example, JP-A-2004-325490).

In the case of a soft counter, a space is not required as compared with a mechanical counter, and it is sufficient if there is a space in which a RAM and a ROM can be mounted on a board. Further, although depending on the capacity of a memory, a certain degree of many counters can be provided.

On the other hand, colorization on the market quickly spreads, and it appears that it becomes necessary to include more counters in order to meet the needs of users.

As compared with the mechanical counter, in the soft counter, the kinds of manageable counters are remarkably increased. However, a further improvement is desired from the demands of users.

Although the soft counter is used, in the present circumstances, the counter is classified merely by a print mode or a sheet size. Specifically, the classification is performed merely based on whether the color mode is full color, mono color or white and black, whether the print side is a single side or double sides, whether the sheet size is a large size or a small size, whether the function is copy, print or fax, or the kind of the combination of these.

BRIEF SUMMARY OF THE INVENTION

It is an object of the present invention to provide an image forming apparatus in which billing is performed according to a kind of a print operation.

In an aspect of the present invention, an image forming apparatus in which billing is performed according to a kind of a print operation includes a number-of-sheet counter to count the number of sheets on which the print operation is performed from an operation start of the image forming apparatus to an operation end, an integrating counter to store the integrated number of sheets printed by the image forming apparatus, a multiplication rate setting unit to set a multiplication rate weighted according to a degree of consumption of a consumable product used in the image forming apparatus, and a billing counter to determine a billing amount from a counter value of the number-of-sheet counter, a counter value of the integrating counter, and the multiplication rate set by the multiplication rate setting unit.

DETAILED DESCRIPTION OF THE INVENTION

Throughout this description, the embodiments and examples shown should be considered as exemplars, rather than limitations on the apparatus and methods of the present invention.

Hereinafter, an embodiment of the invention will be described with reference to the drawings.

Figure 1:
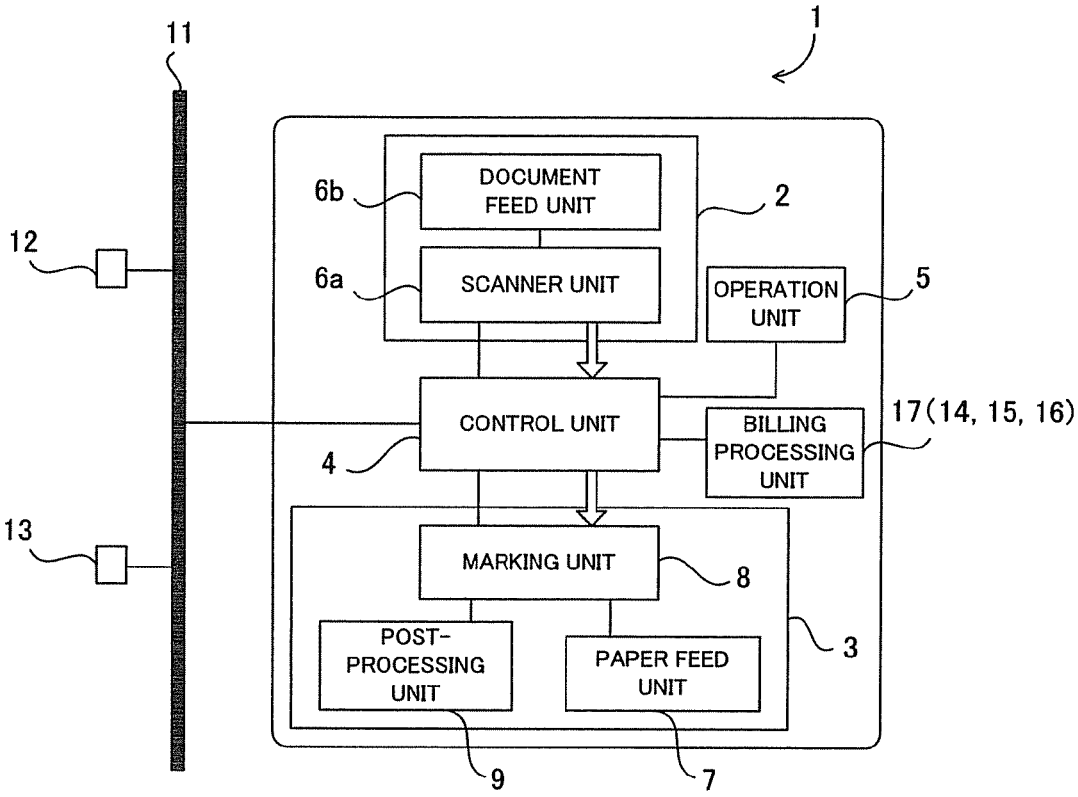
FIG. 1 is a schematic block diagram of an image forming apparatus of an embodiment of the invention.

FIG. 1 is a functional block diagram of an image forming apparatus according to the embodiment.

An image forming apparatus 1 roughly includes a reader unit 2 as an image input device to read an original document, a printer unit 3 as an image output device to print the original document read by the reader unit 2, a control unit 4 to control the reader unit 2 and the printer unit 3, and an operation unit 5 by which an operator makes an input to the control unit 4.

The respective units will be described in sequence. The reader unit 2 optically reads an original document image and converts it into image data. The reader unit 2 includes a scanner unit 6*a* having a function to read the original document, and a document feed unit 6*b* having a function to transport the original sheet.

The printer unit 3 transports a record sheet, prints image data as a visible image on its surface, and discharges it to the outside of the apparatus. The printer unit 3 includes a paper feed unit 7 having plural kinds of record sheet cassettes, a marking unit 8 having a function to transfer and fix the image data to the record sheet, and a post-processing unit 9 having a function to sort and staple the printed record sheet and to output it to the outside.

The control unit 4 is electrically connected to the reader unit 2 and the printer unit 3.

Besides, in the case of the multi-function apparatus, the control unit 4 is connected to a host computer 12, 13 through a network 11. The computer 12, 13 is means for inputting the setting from a user, and specifies, for example, a normal print mode or a toner saving mode.

Besides, the control unit 4 provides a copy function to control the reader unit 2, to read image data of an original document, to control the printer unit 3 and to output the image data to a record sheet. Besides, the control unit provides a scanner function to convert image data read from the reader unit 2 into code data and to transmit it to the host computer 12, 13 through the network 11. Besides, the control unit provides a printer function to convert code data received from the host computer 12, 13 through the network 11 into image data and to output it to the printer unit 3.

A billing processing unit 17 including three kinds of counters 14, 15 and 16 is incorporated in or connected to the control unit 4.

Figure 2:
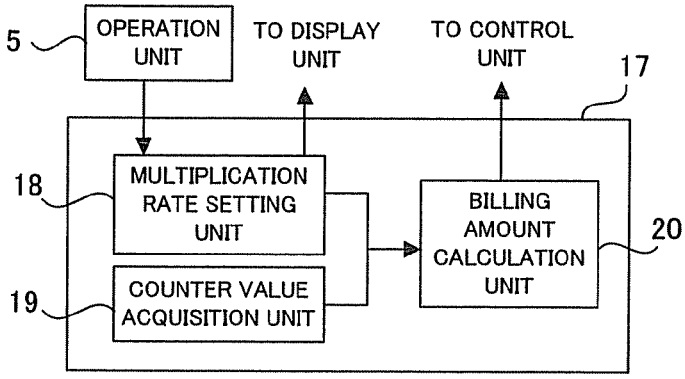
FIG. 2 is a schematic block diagram of a billing processing unit of the image forming apparatus shown in FIG. 1.

FIG. 2 is a schematic block diagram of the billing processing unit 17 of the image forming apparatus. The three kinds of counters are (1) a number-of-sheet counter 14 to count the number of sheets on which a print operation is performed from the operation start of the image forming apparatus to the operation end, (2) an integrating counter 15 to store the integrated number of sheets on which the image forming apparatus 1 prints, and (3) a billing counter 16 indicating a billing amount. The billing processing unit 17 has a multiplication rate setting unit 18, and a multiplication rate for billing is set by this multiplication rate setting unit 18 according to the content of the processing executed in the image forming apparatus 1. The multiplication rate will be described later. The content of the processing executed in the image forming apparatus 1 includes, for example, monochrome printing, full-color printing, continuous printing, reduced printing and the like.

The values of the number-of-sheet counter 14 and the integrating counter 15 are acquired by a counter value acquisition unit 19 to acquire a counter value from the image forming apparatus. The acquired counter value is calculated by a billing calculation unit 20 based on the multiplication rate set by the multiplication rate setting unit 18, and the billing amount is set based on the calculation result. The data of the calculated billing amount is sent to the control unit 4, and addition in the billing counter 16 is performed.

In the setting of the billing in which the unit cost and the number of sheets are multiplied as in the related art, there occurs a case where the value of the billing is not necessarily suitable. For example, the consumption degree of a mechanical part, such as a paper feed roller of the image forming apparatus, toner and the like varies according to an image formation condition.

That is, even in the cases where the numbers of sheets printed are equal to each other and are 10, between the case where the sheets are intermittently printed one by one and the integrated result is 10 and the case where 10 sheets are continuously printed, because of the rising and falling of the image forming apparatus or the existence of an idle time, the consumption degree of the mechanical part, such as a paper feed roller or a transfer roller, or the consumption amount of toner is different. Essentially, it is desirable that the difference is suitably reflected in the billing.

Besides, when multiplication rates relating to the number of sheets, size, material and the like, which become standards for the billing, are once determined, it is difficult to change them later. This is because, in the related art, the setting of the multiplication rate is realized in, for example, a previously installed program, and the setting is performed by fixed means.

Then, in this embodiment, billing corresponding to the consumption amount of a consumable product and the like of the image forming apparatus is performed, so that a fairer burden on users is realized.

The operation unit of the image forming apparatus is provided with a display unit, and information of multiplication rates corresponding to use conditions of the image forming apparatus can also be shown to the user in advance. The user who sees this information can select an inexpensive billing condition. For example, when the sheet is made one size smaller than a previously planned sheet size, or the continuous print setting is set, the image formation can be realized at cost lower than the first.

It is very reasonable that when the user changes the use condition of the image forming apparatus, the multiplication rate can be easily changed.

A service man or the like executes the billing after seeing the counter value of the billing counter. In the case where the user finishes the payment corresponding to the billing amount, the billing counter may be cleared to zero. It is needless to say that even if clearing to zero is not performed, the management of billing can be performed.

When the image forming apparatus starts the operation of the image formation and print operation by the start of copy or print, the number of sheets used is counted. The number-of-sheet counter 14 is counted up. Here, the count number can be made different according to the sheet size. For example, in the case of A4, the count is up by one, and in the case of A3, the count is up by two.

When the image formation and print operation of the image forming apparatus is ended, that is, when the copy or print operation is ended and the machine body is stopped, the value of the number-of-sheet counter 14 is added to the integrating counter 15. Next, the multiplication rate previously set by the multiplication rate setting unit 18 according to the counter value of the number-of-sheet counter 14 is multiplied. The multiplication rate can be made to have various meanings. In the case where plural copies are formed for the same original document, as the number of copies is increased, the degree of consumption of a consumable product per one copy is decreased. In that case, the multiplication rate corresponds to the rate of volume discount. For example, when the value of the number-of-sheet counter 14 is 10 or more, the multiplication rate is 0.99, and the discount is 1%. When the value of the number-of-sheet counter 14 is 100 or more, the multiplication rate is 0.8, and the discount is 20%.

Now, in the case where the count value of the number-of-sheet counter 14 is 123, it is assumed that the multiplication rate of 0.8 is selected. The selected multiplication rate of 0.8 is multiplied to 123. As a result, 98 is added to the billing counter 16.

The multiplication rates can be stored in a memory as, for example, a form of a reference table.

When a new image formation and print operation is started, the number-of-sheet counter is initialized, count-up is again performed from one, and the foregoing series of processing operations are performed.

The multiplication rate can be changed by, for example, a self-diagnosis mode or the like. A billing can be automatically and easily changed by changing the multiplication rate. By that, it becomes possible to easily perform provision of various services to users.

Further, it is possible to apply a different multiplication rate to an individual user. For example, for a large-volume user, a user who makes a contract to receive a specified discount, a user who makes heavy use of both-sided copy, recycled paper or backing paper, or a user who uses a recycled product in a toner cartridge or the like, the multiplication rate can be set to be small.

Also in such a case, the service man who performs the billing is not required to perform complicated billing calculation for each user, and has only to confirm the value of the billing counter. Accordingly, the service cost required for maintenance or the like can also be reduced.

The multiplication rate can be set and changed by the service man. Besides, independently of the setting by the service man, the multiplication rate can also be automatically changed by automatically recognizing the state of the machine body of the image forming apparatus. For example, in the case where it is desired to apply a billing discount to the user who uses recycled toner, the image forming apparatus extracts information, such as the number of recycles or a use state, from an IC tag or the like embedded in the recycled toner, and can automatically rewrite the multiplication rate based on the information.

Next, a flow of determination of billing in the image forming apparatus 1 having the foregoing structure will be described.

Figure 3:
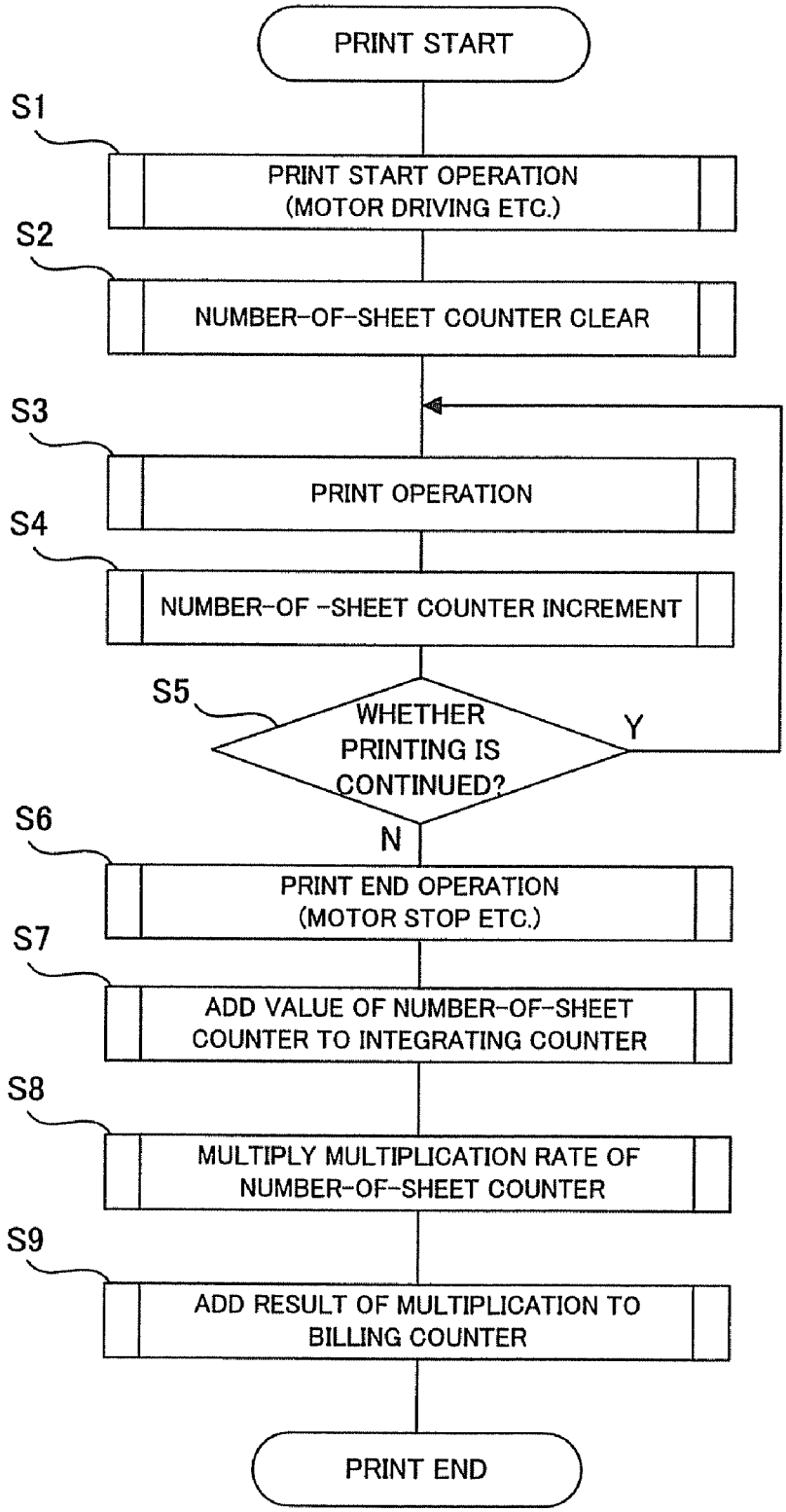
FIG. 3 is a flowchart for explaining a flow of billing of the image forming apparatus shown in FIG. 1.
Figure 4:
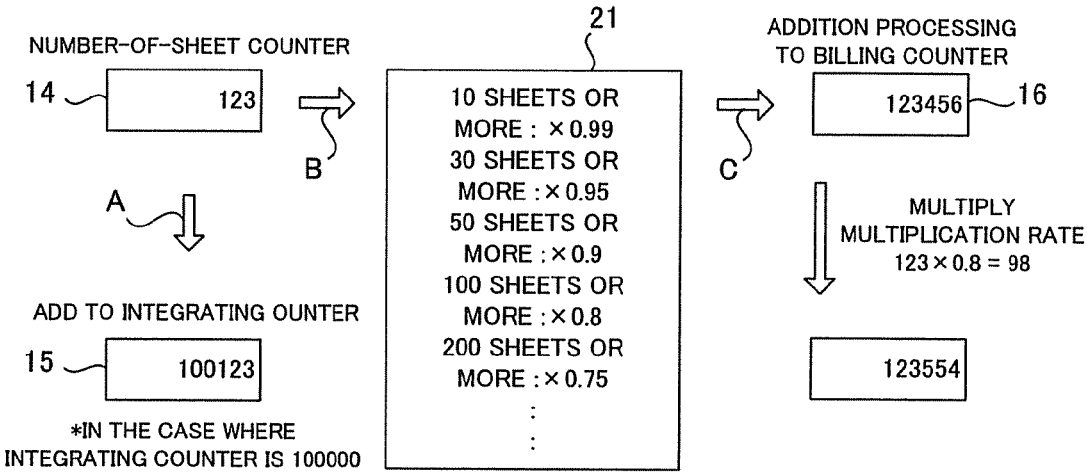
FIG. 4 is a schematic explanatory view for explaining a relation among respective counters of the image forming apparatus shown in FIG. 1.

FIG. 3 is a flowchart of the flow of the determination of the billing in the image forming apparatus 1. FIG. 4 is a schematic explanatory view for explaining processing among the number-of-sheet counter 14, the integrating counter 15 and the billing counter 16.

First, when an operator performs a specified operation of a print start by the operation unit 5, the image forming apparatus 1 performs a print start operation by motor driving and the like (step S1).

By the print start operation, the number-of-sheet counter 14 is initialized and the numerical value is cleared (step S2).

Then, the print operation proceeds (step S3).

As the print operation proceeds, the number-of-sheet counter 14 is counted up, and the count number of sheets is increased. Incidentally, there is also a case where the count number varies according to the sheet size (step S4).

At the time point when the printing is ended, based on the determination of "whether printing is continued?", the image forming apparatus 1 determines "whether printing is further continued" or "whether printing is ended" (step S5).

In the case where it is determined that "printing is ended", the image forming apparatus 1 performs a print end operation by stop of the motor driving, and the like (step S6).

In accordance with the print end operation, as indicated by an arrow A in FIG. 4, the value of the number-of-sheet counter 14 is added to the integrating counter 15 (step S7). For example, the count value of the integrating counter 15 is "100000", and the count value of the number-of-sheet counter 14 is "123", the count value of the integrating counter 15 becomes "100123".

Besides, in FIG. 4, as indicated by an arrow B, at the same time as the addition of the value of the number-of-sheet counter 14 to the integrating counter 15, a multiplication rate previously determined according to the counter value of the number-of-sheet counter 14 is multiplied. In the example shown in FIG. 4, since the counter value is 100 or more, the multiplication rate of "0.8" is selected.

Next, the result obtained by the multiplication of the multiplication rate previously determined according to the counter value of the number-of-sheet counter 14 is added to the billing counter 16 as indicated by an arrow C in FIG. 4. Here, 0.8 is multiplied to "123 sheets". The result of "98" is added to the billing counter 16. Since the counter value of the billing counter 16 before the addition is "123456", after "98" is added, the counter value of the billing counter 16 becomes "123554".

Then the printing is ended.

Incidentally, at step S5, in the determination of "whether printing is continued?", in the case where it is determined that "printing is further continued", from the print operation of step S3, the respective steps after step S4 successively proceed in accordance with the flowchart.

When all printing is ended, at the time when a next new print operation is started, the number-of-sheet counter 14 is initialized, count-up is again performed from one, and the series of operations of the foregoing respective steps are performed.

The steps according to the flow explained in the flowchart are successively performed, and as a result, the value of the number-of-sheet counter 14, which is used in the related art as the counter to simply count the sheets used, is added to the integrating counter 15, and the counter value obtained by taking the consumption degree of the consumable product into consideration is counted up by the billing counter.

By doing so, the counter in the related art, which simply counts the sheets used, becomes the integrating counter, and the count value obtained by taking the consumption degree of the consumable product into consideration is counted up by the billing counter. The billing is determined by using the value of the billing counter, so that unfair billing due to the usage of the machine body is prevented in view of the true consumption degree of the consumable product, and the proper billing can be performed.

Besides, the service man is not required to particularly pay attention to a discount system, and has only to determine the billing amount by seeing the count value of the billing counter, and a burden, such as troublesome calculation work, as in the related art does not occur.

As described above, according to the embodiment of the invention, it becomes possible to perform the billing corresponding to the true consumption degree of the consumable product including the mechanical part or the like used in the image forming apparatus, and the problem of unfair billing to the user can be solved.

The invention is not limited to the embodiment as described, and at the practical stage, the structural elements can be modified and embodied within the scope not departing from the gist of the invention. Besides, various inventions can be formed by suitable combination of the plural structural elements disclosed in the embodiment. For example, some structural elements may be deleted from all structural elements described in the embodiment, and structural elements of different embodiments may be suitably combined.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus in which billing is performed according to a kind of a print operation, comprising:

a number-of-sheet counter to count the number of sheets on which the print operation is performed from an operation start of the image forming apparatus to an operation end;

an integrating counter to store the integrated number of sheets printed by the image forming apparatus;

a multiplication rate setting unit to set a multiplication rate weighted according to a degree of consumption of a consumable product used in the image forming apparatus, the multiplication rate can be set and changed by using a self-diagnosis mode included in the image forming apparatus; and a billing counter to determine a billing amount from a counter value of the number-of-sheet counter, a counter value of the integrating counter, and the multiplication rate set by the multiplication rate setting unit.

2. The image forming apparatus according to claim 1, wherein the multiplication rate varies according to each user and is set to be small for a user who uses at least one of recycled paper and backing paper.

3. The image forming apparatus according to claim 1, wherein the multiplication rate varies according to each user and is set to be small for a user who uses a toner cartridge of a recycled product.

4. The image forming apparatus according to claim 1, wherein the multiplication rate varies according to each user and is set to be small for a user who uses at least one of both-sided copy.

5. The image forming apparatus according to claim 1, wherein the multiplication rate varies according to an extracted information from a recycled toner by the image forming apparatus, such as the number of recycles or a use state.

6. The image forming apparatus according to claim 1, wherein the multiplication rates can be stored in a memory.

7. The image forming apparatus according to claim 6, wherein the multiplication rates can be stored in the memory in a form of a reference table.

* * * * *